US005217350A

United States Patent [19]

Kimura et al.

[11] Patent Number: 5,217,350

[45] Date of Patent: Jun. 8, 1993

[54] WATER PUMP

[75] Inventors: Kenji Kimura; Kiyoshi Miyazaki; Toshihide Matsunaga; Shoji Isobe; Shigeru Itoh; Naokazu Kawase; Tsutomu Kishi, all of Saitama, Japan

[73] Assignee: Honda Giken Kogyo Kabushiki Kaisha, Tokyo, Japan

[21] Appl. No.: 811,435

[22] Filed: Dec. 23, 1991

[30] Foreign Application Priority Data

Dec. 28, 1990 [JP] Japan ..... 2-409515
Oct. 8, 1991 [JP] Japan ..... 3-260085

[51] Int. Cl.[5] ..... F01D 5/08

[52] U.S. Cl. ..... 415/175; 415/177; 415/180

[58] Field of Search ..... 415/175, 177, 180; 416/169 A

[56] References Cited

U.S. PATENT DOCUMENTS 3,258,199 6/1966 Anderson ..... 415/175

FOREIGN PATENT DOCUMENTS 2344297 6/1975 Fed. Rep. of Germany ... 416/169 A
6847190 10/1939 France ..... 415/175
0145101 12/1978 Japan ..... 415/175
0957506 5/1964 United Kingdom ..... 416/196 A

*Primary Examiner*—Thomas E. Denion
*Attorney, Agent, or Firm*—Armstrong, Westerman, Hattori, McLeland & Naughton

[57] ABSTRACT

A cylindrical support portion is provided on a wafer pump case to surround a rotary shaft, and a cylindrically formed power transmitting rotary wheel surrounding the support portion is integrally coupled to an outer end of the rotary shaft which protrudes outwardly from the support portion. A bearing means is interposed between an inner surface of the power transmitting rotary wheel and an outer surface of the support portion. A plurality of sealing members disposed concentrically with the bearing means are interposed between the rotary shaft and an inner surface of the cylindrical support portion at a location axially outwardly spaced from the mechanical seal, and a grease is filled between the sealing members. The water pump structure not only improves the sealing property of the sealing members by providing the sealing members at a location in which the deflection of the rotary shaft is smallest, but also increases the retaining property for the grease between the plurality of sealing members. This enhances water resistance of the bearing means. Moreover, in spite of the provision of the plurality of sealing members and the bearing means, the water pump structure avoids an undesirable increase in size and remains relatively compact.

23 Claims, 6 Drawing Sheets

WATER PUMP

BACKGROUND OF THE INVENTION

1. Field of the Invention

The present invention is directed to a water pump of the type which includes a rotary shaft rotatably carried on a pump case and having a power transmitting rotary wheel at an axially outer end of the shaft, with the axially inner end of the rotary shaft projecting into a pump chamber defined in the pump case, and a mechanical seal interposed between the rotary shaft and the pump case to face the pump chamber.

2. Description of the Prior Art

Such a water pump is conventionally known, for example, from Japanese Laid-Open Utility Model Application No. 169230/86, wherein the mechanical seal is interposed at a location inward of the bearings in an axial direction of the rotary shaft between the pump case and the rotary shaft carried on the pump case with bearings interposed therebetween. In order to prevent water leakage through the mechanical seal from penetrating into the bearings, a baffle plate is provided on the rotary shaft between the bearings and the mechanical seal, and the pump case is provided with a discharge hole for discharging the water.

In the prior art water pump, however, it is difficult to completely discharge the water from the discharge hole by the aid of the baffle plate which rotates together with the rotary shaft, and it is difficult to reliably inhibit the penetration of water vapor into the bearings.

SUMMARY OF THE INVENTION

Accordingly, it is an object of the present invention to provide a compact water pump designed so that the penetration of water into the bearing means can reliably be inhibited.

To achieve the above object, according to the present invention, there is provided a water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber. The water pump has a cylindrical support portion provided on the pump case to surround the rotary shaft. The power transmitting rotary wheel is formed cylindrically to surround the support portion and is integrally coupled to the outer end of the rotary shaft which protrudes outwardly from the support portion. A bearing means is interposed between an inner surface of the power transmitting rotary wheel and an outer surface of the support portion. A plurality of sealing members are disposed concentrically with the bearing means and interposed between the rotary shaft and an inner surface of the support portion at a location axially outwardly spaced from the mechanical seal, and a grease is filled between the sealing members.

With such an arrangement, it is possible not only to improve the sealing property of the sealing members by disposing the sealing members at a location in which the deflection of the rotary shaft is smallest, but also to improve the retaining property of the grease between the plurality of sealing members. This can substantially enhance water resistance of the bearing means. Moreover, this structure avoids an increase in the size of the water pump, in spite of the provision of the plurality of sealing members and the bearing means.

In another aspect of the present invention, there is provided a water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber. The water pump has a cylindrical support portion provided on the pump case to surround the rotary shaft. The power transmitting rotary wheel is formed cylindrically to surround the support portion and is integrally coupled to the outer end of the rotary shaft which protrudes outwardly from the support portion. A bearing means is interposed between an inner surface of the power transmitting rotary wheel and an outer surface of the support portion. A sealing member is disposed concentrically with the bearing means and interposed between the rotary shaft and an inner surface of the support portion at a location axially outwardly spaced apart from the mechanical seal. A fan is fixed to the rotary shaft and contained in an annular chamber which is defined between the mechanical seal and the sealing members to surround the rotary shaft. An intake passage is provided in at least one of the pump case and the rotary shaft and has an open outer end and an inner end communicating with the annular chamber. A discharge hole is provided in a lower portion of the pump case and has an open outer end and an inner end communicating with the annular chamber.

The above arrangement ensures that it is possible to improve the water resistance of the bearing means and to avoid an increase in size of the water pump by efficiently discharging water leakage through the mechanical seal to the annular chamber and by improving the sealing property of the sealing members due to the disposition of the sealing members at a location where the deflection of the rotary shaft is smallest.

In a further aspect of the present invention, there is provided a water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber. The water pump has a cylindrical support portion provided on the pump case to surround the rotary shaft. The power transmitting rotary wheel is formed cylindrically to surround the support portion and is integrally coupled to the outer end of the rotary shaft which protrudes outwardly from the support portion. A bearing means is interposed between an inner surface of the power transmitting rotary wheel and an outer surface of the support portion. A sealing member is disposed concentrically with the bearing means and interposed between the rotary shaft and an inner surface of the support portion at a location axially outwardly spaced apart from the mechanical seal. At least one through-hole is provided in a connection portion connecting the outer end of the rotary shaft and the power transmitting rotary wheel and has an axis parallel to the rotary shaft. One end of the bearing means faces the throughhole.

With the above arrangement, it is possible not only to improve the sealing property of the sealing members by the disposition of the sealing members at a location in which the deflection of the rotary shaft is smallest, but also to cool the bearing means and the sealing members by air flowing through the through-hole. In addition, it is also possible to mount the bearing means between the support portion and the power transmitting rotary wheel via the through-hole which increases mounting accuracy. Moreover, in spite of the provision of the sealing member and the bearing means, it is possible to avoid an increase in the size of the water pump.

The above and other objects, features and advantages of the invention will become apparent from a consideration of the following description of the preferred embodiments, taken in conjunction with the accompanying drawings.

BRIEF DESCRIPTION OF THE INVENTION

FIGS. 1 to 3 illustrate a first embodiment of the present invention, wherein FIG. 1 is a side view of an engine with a water pump of the first embodiment disposed;

FIG. 2 is a front view of the water pump; and

FIG. 3 is a sectional view taken along a line 3—3 in FIG. 2;

FIGS. 5 and 6 illustrate a third embodiment of the present invention, wherein FIG. 5 is a partially cutaway front view of a water pump of the third embodiment; and FIG. 6 is a sectional view taken along a line 6—6 in FIG. 5.

DESCRIPTION OF THE PREFERRED EMBODIMENTS

The present invention will now be described by way of preferred embodiments thereof in connection with the accompanying drawings.

Figure 1:
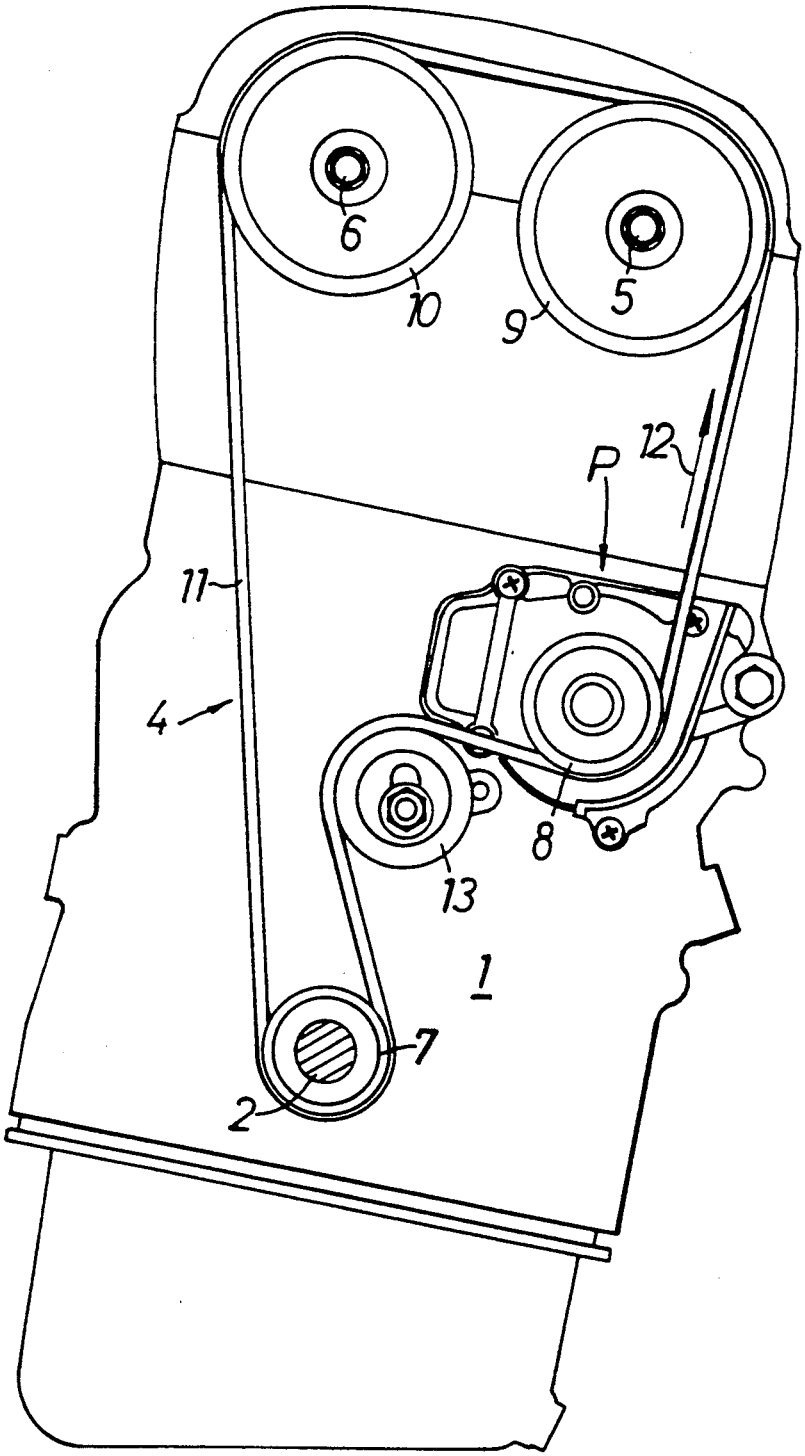

A first embodiment of the present invention will be described with reference to FIGS. 1 to 3. Referring first to FIG. 1, a water pump P is disposed on a side surface of an engine body 1 in a DOHC type engine for an automobile, and a power from a crankshaft 2 is transmitted through a wrapping connector transmission device 4 to the water pump P. The wrapping connector transmission device 4 is a timing transmitting device for driving the water pump P and a pair of valve operating cam shafts 5 and 6 rotatably carried on an upper portion of the engine body in parallel to the crankshaft 2, and comprises a timing belt 11 reeved or passed over a driving pulley 7 which is fixed to the crankshaft 2, a follower pulley 8 for driving the water pump P, and follower pulleys 9 and 10 fixed to the valve-operating cam shafts 5 and 6, respectively. The water pump P and the valve operating cam shafts 5 and 6 are rotatably driven by the timing belt 11 driven in a travelling direction as shown by an arrow 12 in FIG. 1 by the driving pulley 7. Moreover, a tensioner 13 for adjusting the tension of the timing belt 11 is provided between the driving pulley 7 and the follower pulley 8 and resiliently biased into contact with the timing belt 11.

Figure 2:
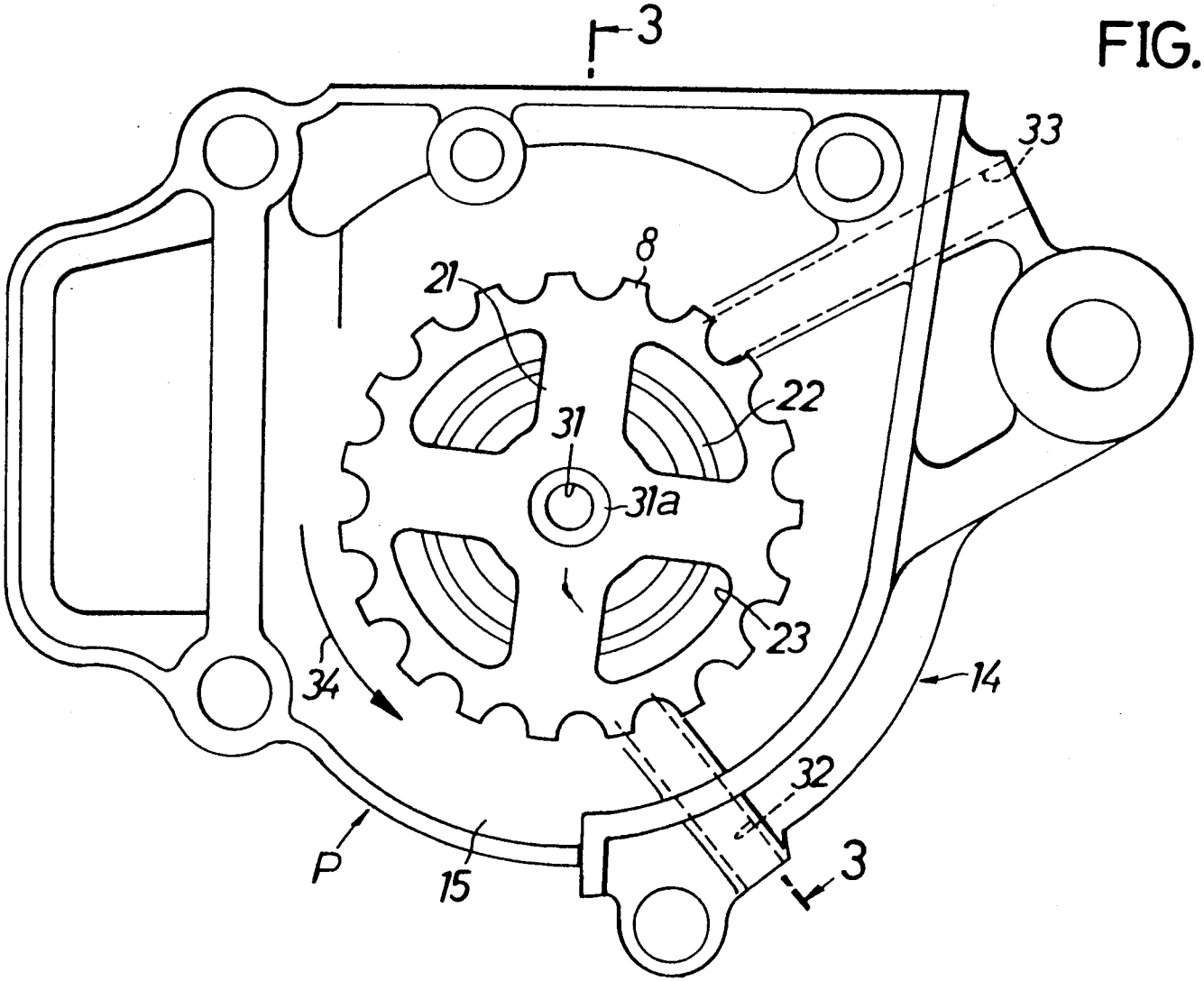
Figure 3:
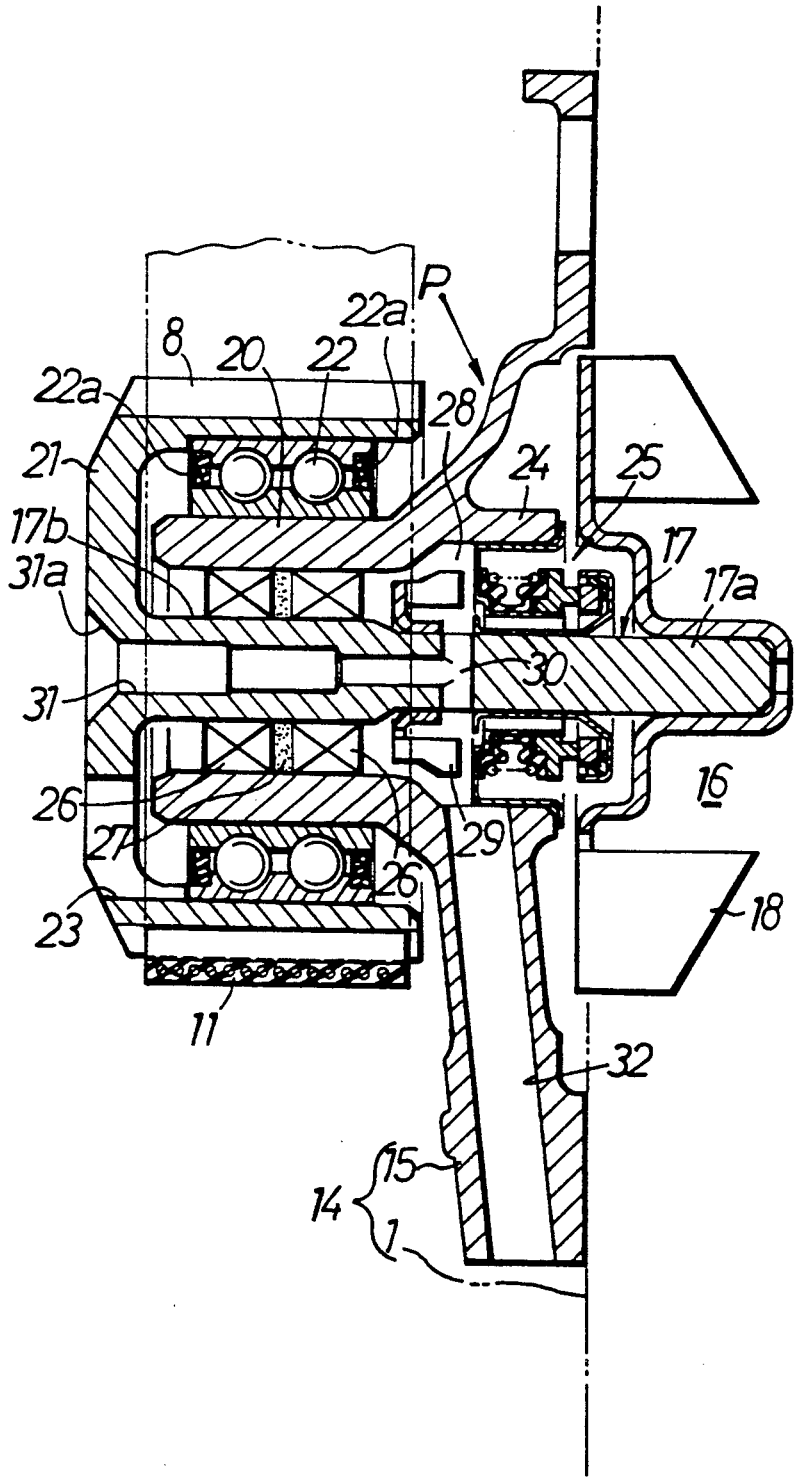

Referring to FIGS. 2 and 3, the water pump P has a pump case 14 which is comprised of the engine body 1, and a cover 15 secured to the side surface of the engine body 1 to define a pump chamber 16 between the cover 15 and the engine body 1. An impeller 18 is press-fitted onto and fixed to an axially inner end of a rotary shaft 17 which is rotatably carried on the pump case 14 and projects into the pump chamber 16. The follower pulley 8 is mounted as a power transmitting rotary wheel at an outer end of the rotary shaft 17 projecting from the cover 15.

A cylindrically formed support portion 20 is integrally provided on the cover 15 in the pump case 14, and the rotary shaft 17 is disposed to coaxially pass through the support portion 20. The outer end of the rotary shaft 17 which protrudes outwardly from the support portion 20 is coaxially and integrally coupled through a connection 21 with the cylindrically formed follower pulley 8 coaxially surrounding the support portion 20.

A double row ball bearing 22 is interposed as bearing means between an inner surface of the follower pulley 8 and an outer surface of the support portion 20. Thus, the rotary shaft 17 is rotatably carried on the cover 15, i.e., on the pump case 14 with the double row ball bearing 22 interposed therebetween. Moreover, sealing members **22*a*, 22*a* are provided between axially opposite ends of inner and outer loops of the double row ball bearing 22, and serve to prevent water and dust from penetrating int the double row ball bearing 22. A plurality of, e.g., four through-holes 23 are provided in the connection 21 at circumferentially spaced locations to each have an axis parallel to the rotary shaft 17, and an end of the double row ball bearing 22 faces the through-holes 23**.

A cylindrical portion 24 is integrally provided on an inner surface of the cover 15 to protrude toward the pump chamber 16 so as to coaxially surround an inner end of the support portion 20, and a conventionally well-known mechanical seal 25 is interposed between the cylindrical portion 24 and the rotary shaft 17 to face the pump chamber 16. Further, a pair of sealing members 26, 26 are interposed at an axial distance between an inner surface of the support portion 20 and an outer surface of the rotary shaft 17 in axial locations substantially corresponding to the double row ball bearing 22, and a grease 27 is filled between the sealing members 26, 26. The grease 27 is capable of fulfilling a lubricating effect between the sealing members 26, 26 and the rotary shaft 17 and a water trapping effect even if water leaks through the sealing member 26 located axially inwardly relative to the rotary shaft 17.

Between the inner sealing member 26 and the mechanical seal 25, inner in an axial direction of the rotary shaft 17, an annular chamber 28 is defined in the cover 15 to surround the rotary shaft 17. A fan 29 is disposed in the annular chamber 28 to extend toward the mechanical seal 25 and fixed to the rotary shaft 17. The fan 29 has a plurality of blades extending radially of the rotary shaft 17. A communication hole 30 is provided in the rotary shaft 17 to extend along one diametrical line and is opened at its opposite ends into the fan 29. An intake passage 31 is also provided coaxially in the rotary shaft 17 with an inner end of the passage 31 communicating with the communication hole 30. An outer end of the intake passage 31 is opened to the outside through a widened portion **31*a* enlarged axially outwardly in a tapered or stepped manner to provide an improved introduction of air. Thus, air is introduced from the outside through the intake passage 31 and the communication hole 30 into the annular chamber 28, while a centrifugal force is applied to such introduced air, by the rotational operation of the rotary shaft 17, i.e., the fan 29**.

There is a possibility of occurrence of a deformation of the rotary shaft 17 and of an attendant failure of sealing by the sealing members 26, 26, because of the provision of the widened portion 31*a* at the outer end of the intake passage 31 as described above. However, the rotary shaft 17 is supported through the double row ball bearing 22 interposed between the support portion 20 and the follower pulley 8 surrounding the support portion 20, so that an excessively large load cannot be applied to the rotary shaft 17, and therefore, there is no fear of such deformation of the rotary shaft 17 and of such attendant failure of sealing by the sealing members 26, 26, thereby ensuring an improved introduction of air into the intake passage 31.

On the other hand, the cover 15 is provided with a discharge hole 32 and an intake passage 33 which are opened at their outer ends to the outside and at their inner ends into the annular chamber 28. The discharge hole 32 is provided in a lower portion of the cover 15 to extend radially outwardly of the rotary shaft 17 from an inner end to an outer end of the hole 32 in a direction 34 of rotation of the rotary shaft 17, and the intake passage 33 is provided in an upper portion of the cover 15 with an acute angle formed by its axis and an axis of the discharge hole 32.

The rotary shaft 17 is comprised of a smaller diameter portion 17*a* which is closer to an axially inner end of the shaft 17 and to which the impeller 18 and a portion of components of the mechanical seal 25 as well as the fan 29 are mounted, and a larger diameter portion 17*b* closer to an axially outer end of the shaft 17 having the sealing members 26, 26 interposed between the larger diameter portion 17*b* and the support portion 20. The smaller and larger diameter portions 17*a* and 17*b* are coaxially interconnected through a tapered step. Such structure ensures that in inserting the rotary shaft 17 into the support portion 20 after the sealing members 26, 26 with the grease 27 filled therebetween have been placed into the support portion 20, damage to the sealing members 26, 26 by the inner end of the rotary shaft 17 is prevented.

The operation of the first embodiment will be described below. The pump chamber 16 and the annular chamber 28 are sealed from each other by the mechanical seal 25 during operation of the water pump P, so that water in the pump chamber 16 is substantially prevented from leaking into the annular chamber 28. However, a complete sealing by the mechanical seal 25 is still difficult, and it is difficult to avoid the leak of a very small amount of water containing water vapor evaporated by a frictional heat in the mechanical seal 25. However, air is introduced from the outside via the intake passages 31 and 32 into the annular chamber 28 by the aid of the fan 29, while a centrifugal force is applied to such introduced air. Therefore, the centrifugal force is also applied to the water and water vapor leaked through the mechanical seal 25 into the annular chamber 28, so that the water vapor and water are forcedly discharged to the outside through the discharge hole 32. Moreover, the mechanical seal 25 can be cooled by air flowing within the annular chamber 28, ensuring that it is possible to suppress the generation of a frictional heat at the mechanical seal 25 to the utmost, and to avoid an increase in temperature due to the frictional heat of the sealing members 26, 26 by air flowing through the intake passage 31 provided in the rotary shaft 17, thereby improving a sealing property of the sealing members 26, 26.

It should be noted that it is difficult to completely discharge the water from the annular chamber 28 by the operation of the fan 29. However, the pair of sealing members 26, 26 are disposed between the annular chamber 28 and the double row ball bearing 22 and hence, even if water is leaked through the inner sealing member 26, the leakage of the water can be stopped by the grease 27 between the sealing members 26, 26. This ensures that the water can be reliably prevented from being leaked from the annular chamber 28 toward the double row ball bearing 22, thereby improving a water resistance.

Moreover, the sealing members 26, 26 are interposed between the support portion 20 and the rotary shaft 17 at a place where the deflection of the rotary shaft 17 is smallest during application of an external load to the rotary shaft 17, i.e., at an axial location substantially corresponding to the double row ball bearing 22, and therefore, it is possible to exhibit an excellent sealing effect by the sealing members 26, 26, thereby further improving water resistance and minimizing the length of the support portion 20 and enhancing compactness of the water pump P.

The provision of the plurality of through-holes 23 in the connection 21 connecting the rotary shaft 17 and the follower pulley 8 ensures that the double row ball bearing 22 and the sealing members 26, 26 can be cooled by flowing air, and the ball bearings 22 can be mounted with an increased mounting accuracy by use of the through holes 23.

Figure 4:
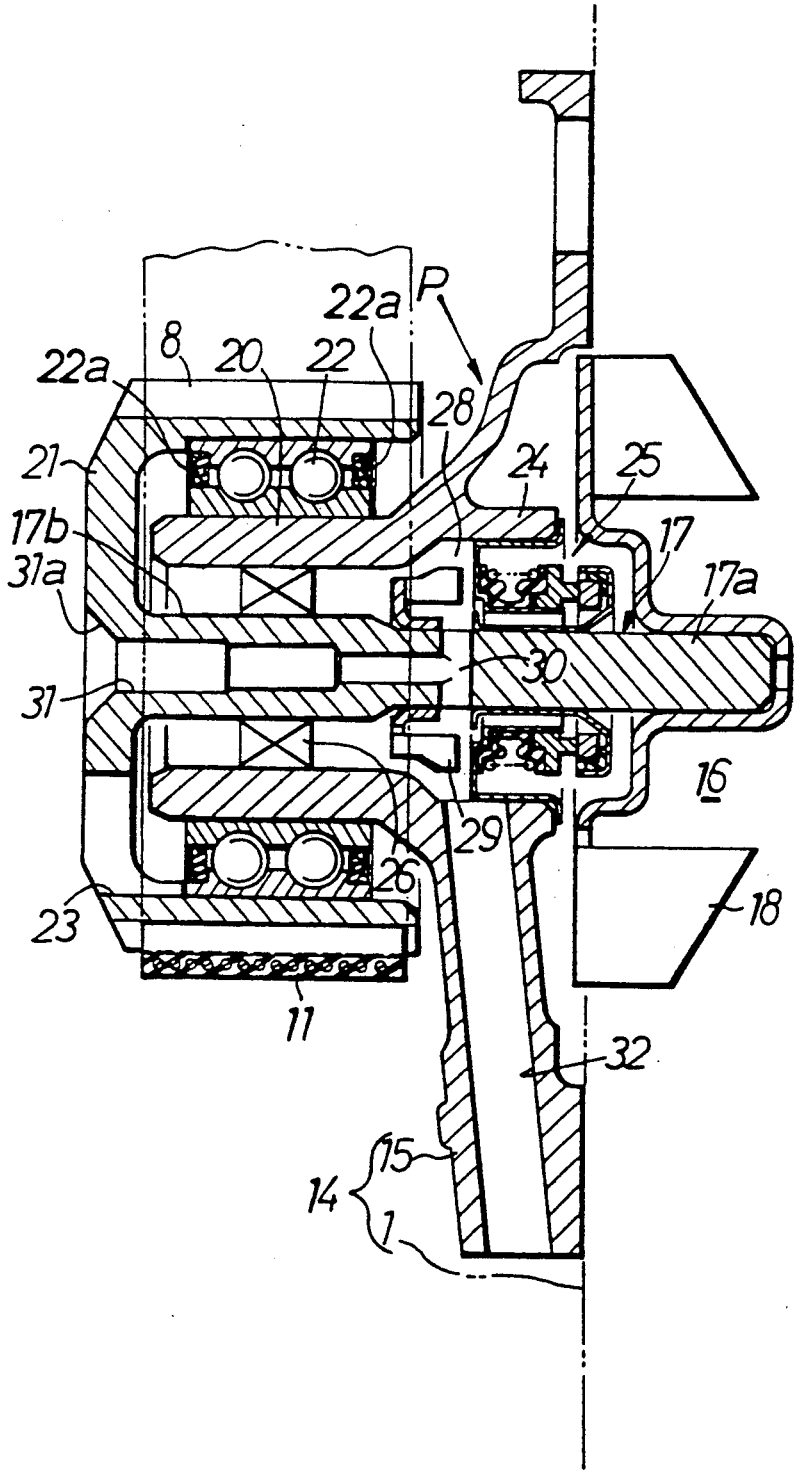
FIG. 4 is a sectional view similar to FIG. 3, but illustrating a second embodiment of the present invention.

FIG. 4 illustrates a second embodiment of the present invention, wherein a single sealing member 26 is interposed between the rotary shaft 17 and the support portion 20. In this case, the sealing property is reduced as compared with the previously described embodiment, but the penetration of water into the double row ball bearing 22 can be reliably prevented as compared with the prior art.

Figure 5:
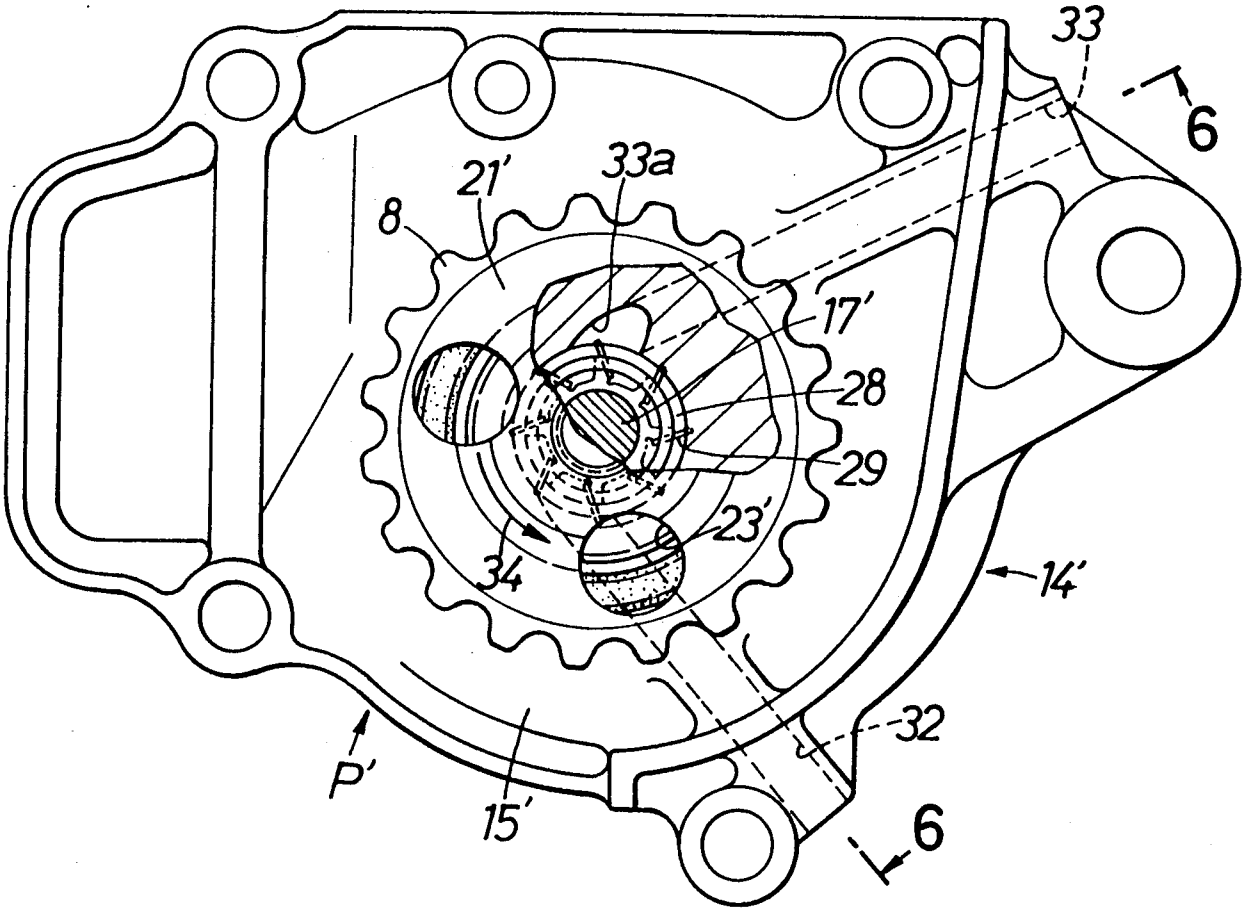
Figure 6:
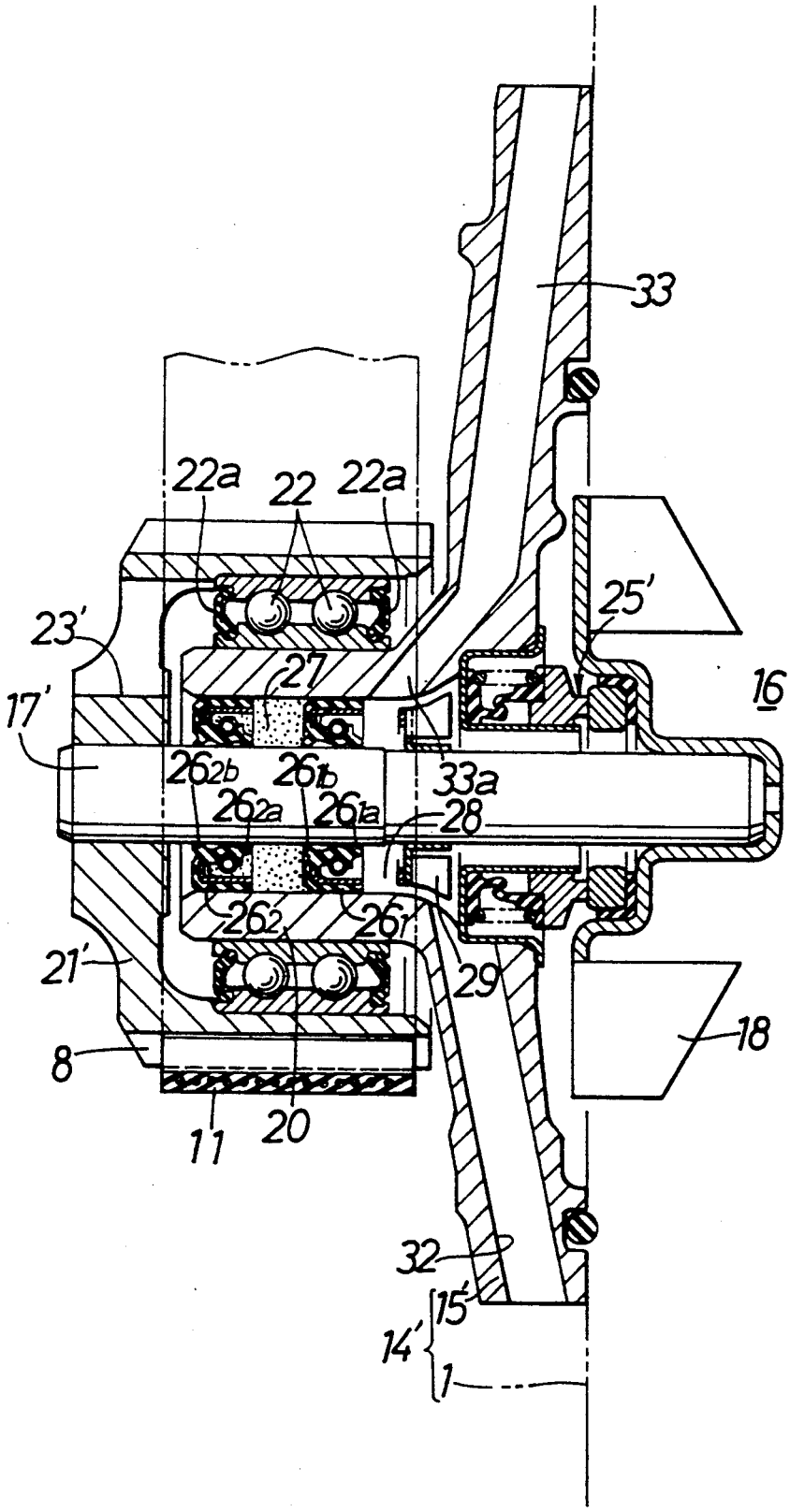

FIGS. 5 and 6 illustrate a third embodiment of the present invention, FIG. 5 being a partially cutaway front view of a water pump, and FIG. 6 being an enlarged sectional view taken along a line 6—6 in FIG. 5.

The water pump P, has a pump case 14' which is comprised of an engine body 1, and a cover 15' secured to a side surface of the engine body 1 to define a pump chamber 16 between the cover 15' itself and the engine body 1. A rotary shaft 17' is rotatably carrie on the pump case 14' and has, at its axially inner end, an impeller 18 contained in the pump chamber 16. The above-described follower pulley 8 is mounted as a power transmitting rotary wheel at the outer end of the rotary shaft 17' which protrudes from the cover 15'.

A cylindrically formed support portion 20 is integrally provided on the cover 15' in the pump case 14'. The rotary shaft 17' is disposed to pass coaxially through the support portion 20. A connection 21' is integrally provided on the cylindrically formed follower pulley 8 coaxially surrounding the support portion 20. The correction 21' projects radially inwardly from an axially outer end of the follower pulley 8. The follower pulley 8 is fixedly connected to an outer end of the rotary shaft 17' by press-fitting of the outer end of the rotary shaft 17' into a central portion of the connection 21'.

The double row ball bearing 22 is interposed between an inner surface of the follower pulley 8 and an outer surface of the support portion 20. Thus, the rotary shaft 17' is rotatably carried on the cover 15', i.e., the pump case 14' with the double row ball bearing 22 interposed therebetween. The connection 21' is provided with a plurality of, e.g. three, circumferentially spaced through-holes 23' which face one end of the double row ball bearing 22.

A conventionally well-known mechanical seal 25' is interposed between an inner surface of the cover 15' and the rotary shaft 17'. Further, a first $26_1$ and a second oil seal $26_2$ are interposed at an axial distance between an inner surface of the support portion 20 and an outer surface of the rotary shaft 17' at an axial location substantially corresponding to the double row ball bearing 22. The oil seals $26_1$ and $26_2$ are each formed into a substantially U-shape in cross section to have main lips $26_{1a}$ and $26_{2a}$ in sliding contact with the rotary shaft 17' and side lips $26_{1b}$ and $26_{2b}$ having a predetermined clearance (e.g., of 0.2 mm) relative to the rotary shaft 17', respectively, and are disposed in an attitude opened toward the mechanical seal 25'. Moreover, a grease 27 is filled between the oil seals $26_1$ and $26_2$.

The cover 15' is provided with a discharge hole 32 and an intake passage 33 which are open at their outer ends to the outside and at their inner ends into the annular chamber 28. Moreover, an open end 33*a* of the intake passage 33 opens into an inner surface of the annular chamber 28 in front of the fan in an axial direction of the rotary shaft 17', i.e., between the fan 29 and the first oil seal $26_1$. As shown in FIG. 5, the open end 33*a* is open toward the first oil seal $26_1$ at a position along a direction 34 of rotation of the fan 29 and in proximity to the first oil seal $26_1$ which is closer to the annular chamber 28 than the second oil seal $26_2$.

The operation of the third embodiment of the present invention will be described below. Since the open end 33*a* of the intake passage 33 into the annular chamber 28 is open toward the first oil seal $26_1$ at the position along the direction of rotation of the fan 29 and in proximity to the first oil seal $26_1$ which is closer to the annular chamber 28 than the second oil seal $26_2$, air can be smoothly introduced through the intake passage 33 into the annular chamber 28 by rotation of the fan 29, thereby effectively cooling the first oil seal $26_1$ to suppress wear due to a rise in temperature of the oil seal $26_1$ to the utmost and to maintain the desired sealing property. In addition, the provision of the plurality of through-holes 23' in the connection 21' connecting the rotary shaft 17' and the follower pulley 8 ensures that the double row ball bearing 22 and the second oil seal $26_2$ closer to the follower pulley 8 can be cooled, and the mounting of the double row ball bearing 22 can be carried out by use of the through-holes 23'.

Moreover, since the oil seals $26_1$ and $26_2$ each having the substantially U-shaped cross section are in the attitude opened toward the mechanical seal 25', i.e., toward the annular chamber 28, it is possible to effectively inhibit flowing of water from the annular chamber 28 toward the double row ball bearing 22 and to more effectively cool the first oil seal $26_1$ closer to the annular chamber 28.

Further, since the grease 27 is filled between the first and second oil seals $26_1$ and $26_2$ opened toward the annular chamber 28, it is possible to effectively lubricate the oil seals $26_1$ and $26_2$. If the pressure between the oil seals $26_1$ and $26_2$ is increased at a high temperature, the main lip $26_{1a}$ of the first oil seal $26_1$ is slightly opened, permitting a pressure increment to flow toward the annular chamber 28, so that the pressure between the oil seals $26_1$ and $26_2$ cannot be abnormally increased. Therefore, the main lip $26_{2a}$ of the second oil seal $26_2$ cannot be urged against the rotary shaft 17' more than necessary by an abnormally high pressure. In this case, the grease 27 cannot flow out toward the annular chamber 28 due to catching of a fibrous component in the grease 27 on the side lip $26_{1b}$ of the first oil seal $26_1$.

On the other hand, if the pressure between the oil seals $26_1$ and $26_2$ is reduced at a low temperature, the main lip $26_{2a}$ of the second oil seal $26_2$ is slightly opened, permitting air to be introduced in a very small amount from the outside, so that the lip of the first oil seal $26_1$ cannot be urged against the rotary shaft 17' more than necessary. Therefore, a breathing between the oil seals $26_1$ and $26_2$ is possible, thereby making it possible to prevent an increase in the amount of friction due to urging of the oil seals $26_1$ and $26_2$ against the rotary shaft 17' more than necessary, and to reliably retain the grease 27.

Moreover, since the oil seals $26_1$ and $26_2$ are interposed between the support portion 20 and the rotary shaft 17' at the place where the deflection of the rotary shaft 17' is smallest during application of an external load to the rotary shaft 17', i.e., at the axial location substantially corresponding to the double row ball bearing 22, it is possible to exhibit an excellent sealing effect by the oil seals $26_1$ and $26_2$, thereby improving water resistance and shortening the length of the support portion 20 to provide a more compact water pump P.

Although the double row ball bearing 22 has been used as bearing means in the above embodiments, it will be understood that the present invention is also applicable to a water pump using another bearing means such as roller bearings or slide bearings.

What is claimed is:

1. A water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber, said water pump comprising:

a cylindrical support portion provided on the pump case to surround the rotary shaft, said power transmitting rotary wheel being formed cylindrically to surround the support portion and integrally coupled to an outer end of the rotary shaft which protrudes outwardly from said support portion, a bearing means interposed between an inner surface of the power transmitting rotary wheel and an outer surface of the support portion, a plurality of sealing members disposed concentrically with said bearing means so as to be overlapped with the bearing means in a radial direction and interposed between the rotary shaft and an inner surface of the cylindrical support portion at a location axially outwardly spaced from the mechanical seal, and a grease filled between said sealing members.

2. A water pump according to claim 1, wherein said sealing members are each formed into a substantially U-shape in cross-section and interposed between said rotary shaft and said pump case in an attitude opened toward the mechanical seal.

3. A water pump according to claim 1, further including a fan fixed to said rotary shaft and contained in an annular chamber which is defined between the mechanical seal and the plurality of sealing members to surround said rotary shaft, a first passage in said pump case, said first passage having one end open to said annular chamber and having an outer end open to atmosphere, and a second passage provided in said rotary shaft, said second passage having one end open to said annular chamber and having an outer end open to atmosphere.

4. A water pump according to claim 1, wherein said rotary shaft is comprised of a smaller diameter portion at an axially inner end of the rotary shaft and to which an impeller contained in the pump chamber and a portion of components of the mechanical seal are mounted, a larger diameter portion at an axially outer end of the rotary shaft, the plurality of sealing members are interposed between the larger diameter portion and the cylindrical support portion, and said smaller and larger diameter portions of said rotary shaft are coaxially interconnected through a step.

5. A water pump according to claim 1, wherein said sealing members are formed as oil seals.

6. A water pump according to claim 1, wherein said pcwer transmitting rotary wheel si connected to the outer end of the rotary shaft via a radially extending portion to define an annular space around the rotary shaft, said cylindrical support portion being located in said annular space, said bearing means being disposed in said annular space at a position on a radially outer side of the support portion, and said sealing members being disposed in the annular space at a position on a radially inner side of the support portion.

7. A water pump according to claim 6, wherein the rotary shaft has a larger diameter portion which extends over an axial length substantially corresponding to the annular space.

8. A water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber, said water pump comprising:

a cylindrical support portion provided on the pump case to surround the rotary shaft, said power transmitting rotary wheel being formed cylindrically to surround the support portion and integrally coupled to that outer end of the rotary shaft which protrudes outwardly from said support portion, a bearing means interposed between an inner surface of the power transmitting rotary wheel and an outer surface of the support portion, a sealing member disposed concentrically with said bearing means and interposed between the rotary shaft and an inner surface of the support portion at a location axially outwardly spaced apart from the mechanical seal, a fan fixed to the rotary shaft and contained in an annular chamber which is defined between the mechanical seal and the sealing member around the rotary shaft, an intake passage provided in at least one of the pump case and the rotary shaft, said intake passage having an outer end open to atmosphere and an inner end communicating with the annular chamber, and a discharge hole provided in a lower portion of the pump case and having an open outer end and an inner end communicating with the annular chamber.

9. A water pump according to claim 8, wherein said inner end of said intake passage which communicates with the annular chamber is opened toward the sealing member in a direction of rotation of the fan.

10. A water pump according to claim 8, wherein the sealing member is formed into a substantially U-shape in cross-section and interposed between said rotary shaft and said pump case in an attitude opened toward the mechanical seal, and said inner end of said intake passage which communicates with the annular chamber is opened toward the sealing member in a direction of rotation of the fan.

11. A water pump according to claim 8, wherein said rotary shaft is comprised of a smaller diameter portion at an axially inner end of the rotary shaft and to which an impeller contained in the pump chamber and a portion of components of the mechanical seal and the fan are mounted, a larger diameter portion at an axially outer end of the rotary shaft, the sealing member is interposed between the larger diameter portion and the cylindrical support portion, and said smaller and larger diameter portions of said rotary shaft are coaxially interconnected through a step.

12. A water pump including a rotary shaft rotatably carried on a pump case and having a power transmitting rotary wheel at an axially outer end thereof, with an axially inner end of the rotary shaft projected into a pump chamber defined in the pump case, and a mechanical seal interposed between the rotary shaft and the pump case to face the pump chamber, said water pump comprising:

a cylindrical support portion provided on the pump case to surround the rotary shaft, said power transmitting rotary wheel being formed cylindrically to surround the support portion and integrally coupled to an outer end of the rotary shaft which protrudes outwardly from said support portion, a bearing means interposed between an inner surface of the power transmitting rotary wheel and an outer surface of the support portion, a sealing means disposed concentrically with said bearing means so as to be overlapped with the bearing means in a radial direction and interposed between the rotary shaft and an inner surface of the support portion at a location axially outwardly spaced apart from the mechanical seal, and at least one through-hole provided in a connection portion of said power transmitting rotary wheel connecting the cylindrically formed portion of said power transmitting rotary wheel and the outer end of the rotary shaft and having an axis parallel to the rotary shaft, said bearing means having one end facing said through-hole.

13. A water pump according to claim 12, further including a fan fixed to said rotary shaft and contained in an annular chamber which is defined between the mechanical seal and the sealing means around said rotary shaft, a first passage in said pump case, said first passage having one end open to said annular chamber and having an outer end open to atmosphere, and a second passage provided in said rotary shaft, said second passage having one end open to said annular chamber and having an outer end open to atmosphere.

14. A water pump according to claim 12, wherein said sealing means comprises a plurality of sealing members, and further including a grease filled between the sealing members.

15. A water pump according to claim 12, wherein said rotary shaft is comprised of a smaller diameter portion at an axially inner end of the rotary shaft and to which an impeller contained in the pump chamber and a portion of components of the mechanical seal are mounted, a larger diameter portion at an axially outer end of the rotary shaft, the sealing means being interposed between the larger diameter portion and the cylindrical support portion, and said smaller and larger diameter portions of said rotary shaft are coaxially interconnected through a step.

16. A water pump according to claim 12, wherein said sealing means are formed as oil seals.

17. A water pump according to claim 12, wherein said connection portion of the power transmitting rotary wheel extends radially to define an annular space around the rotary shaft, said cylindrical support portion being located in said annular space, said bearing means being disposed in said annular space at a position on a radially outer side of the support portion, and said sealing means being disposed in the annular space at a position on a radially inner side of the support portion.

18. A water pump according to claim 17, wherein the rotary shaft has a larger diameter portion which extends over an axial length substantially corresponding to the annular space.

19. A water pump including a rotary shaft rotatably carried on a pump case and having a power transmitting rotary wheel at an axially outer end thereof, with an axially inner end of the rotary shaft projected into a pump chamber defined in the pump case, said water pump comprising:

a cylindrical support portion provided on the pump case to surround the rotary shaft, said power transmitting rotary wheel being formed cylindrically to surround the support portion and integrally coupled to that outer end of the rotary shaft which protrudes outwardly from said support portion, a bearing means interposed between an inner surface of the power transmitting rotary wheel and an outer surface of the support portion, a plurality of sealing members disposed concentrically with said bearing means so as to be overlapped with the bearing means in a radial direction and interposed between the rotary shaft and an inner surface of the cylindrical support portion at a location axially outwardly spaced from the mechanical seal, and a grease filled between said sealing members.

20. A water pump according to claim 9, wherein said sealing members are each formed into a substantially U-shape in cross-section and interposed between said rotary shaft and said pump case in an attitude opened toward the mechanical seal.

21. A water pump according to claim 19, further including a fan fixed to said rotary shaft and contained in an annular chamber which is defined between the mechanical seal and the plurality of sealing members to surround said rotary shaft, a first passage in said pump case, said first passage having one end open to said annular chamber and having an outer end open to atmosphere, and a second passage provided in said rotary shaft, said second passage having one end open to said annular chamber and having an outer end open to atmosphere.

22. A water pump according to claim 19, wherein said rotary shaft is comprised of a smaller diameter portion at an axially inner end of the rotary shaft and to which an impeller contained in the pump chamber and a portion of components of the mechanical seal are mounted, a larger diameter portion at an axially outer end of the rotary shaft, the plurality of sealing members are interposed between the larger diameter portion and the cylindrical support portion, and said smaller and larger diameter portions of said rotary shaft are coaxially interconnected through a step.

23. A water pump according to claim 19, wherein a mechanical seal is interposed between the rotary shaft and the pump case to face the pump chamber.

* * * * *